US010089957B2

(12) United States Patent
Cai

(10) Patent No.: US 10,089,957 B2
(45) Date of Patent: Oct. 2, 2018

(54) PAGE DISPLAY METHOD AND TERMINAL

(71) Applicant: TENCENT TECHNOLOGY (SHENZHEN) COMPANY LIMITED, Shenzhen (CN)

(72) Inventor: Yingyuan Cai, Shenzhen (CN)

(73) Assignee: TENCENT TECHNOLOGY (SHENZHEN) COMPANY LIMITED, Shenzhen (CN)

( * ) Notice: Subject to any disclaimer, the term of this patent is extended or adjusted under 35 U.S.C. 154(b) by 0 days.

(21) Appl. No.: 15/951,997

(22) Filed: Apr. 12, 2018

(65) Prior Publication Data

US 2018/0233106 A1 Aug. 16, 2018

Related U.S. Application Data

(63) Continuation of application No. 15/209,534, filed on Jul. 13, 2016, now Pat. No. 9,984,657, which is a (Continued)

(30) Foreign Application Priority Data

Feb. 18, 2014 (CN) ..... 2014 1 0054236

(51) Int. Cl.
*G09G 5/02* (2006.01)
*G09G 3/22* (2006.01)
*G09G 3/34* (2006.01)

(52) U.S. Cl.
CPC ..... *G09G 5/024* (2013.01); *G09G 3/22* (2013.01); *G09G 3/34* (2013.01); (Continued)

(58) Field of Classification Search
CPC ..... G09G 5/024; G09G 2320/0295; G09G 2320/0666; G09G 2320/08; G09G 3/22; (Continued)

(56) References Cited

U.S. PATENT DOCUMENTS

2005/0093850 A1* 5/2005 Mori ..... G09G 3/007 345/204
2007/0109284 A1* 5/2007 Yamazaki ..... G09G 3/20 345/204

(Continued)

FOREIGN PATENT DOCUMENTS

CN 1639762 A 7/2005
CN 1912975 A 2/2007

(Continued)

OTHER PUBLICATIONS

The State Intellectual Property Office of the People's Republic of China (SIPO), Office Action 1 for 201410054236.3, dated Jul. 3, 2018, 12 Pages (including translation).

*Primary Examiner* — Xilin Guo

(74) *Attorney, Agent, or Firm* — Anova Law Group, PLLC

(57) ABSTRACT

Disclosed are a page display method and apparatus, which relate to the display field. The method includes: rendering a current page to be displayed to obtain a page image; acquiring gray values of pixels in the page image; determining a display mode according to the acquired gray values, the display mode including a white mode and a black mode; judging whether the display mode matches a screen light-emitting type, the screen light-emitting type including backlight light-emitting and self light-emitting; and performing color inversion processing on the page image and displaying the processed page image when the display mode does not match the screen light-emitting type.

18 Claims, 5 Drawing Sheets

Related U.S. Application Data continuation of application No. PCT/CN2015/072370, filed on Feb. 6, 2015.

(52) U.S. Cl.
CPC ..... *G09G 2320/0271* (2013.01); *G09G 2320/0295* (2013.01); *G09G 2320/0666* (2013.01); *G09G 2320/08* (2013.01); *G09G 2330/021* (2013.01); *G09G 2360/16* (2013.01)

(58) Field of Classification Search
CPC ..... G09G 3/24; G09G 2320/0271; G09G 2330/021; G09G 2360/16; G09G 5/06; G09G 5/02; G09G 3/2003; G06T 11/001
See application file for complete search history.

(56) References Cited

U.S. PATENT DOCUMENTS

| | | | | |
|---|---|---|---|---|
| 2008/0031488 | A1 | 2/2008 | Sato | |
| 2008/0100554 | A1 | 5/2008 | Mori | |
| 2009/0140665 | A1 | 6/2009 | Park | |
| 2011/0074803 | A1* | 3/2011 | Kerofsky ..... | G09G 3/3406 345/589 |
| 2013/0314453 | A1* | 11/2013 | Ko ..... | G09G 5/10 345/690 |

FOREIGN PATENT DOCUMENTS

| | | | |
|---|---|---|---|
| CN | 101118561 | A | 2/2008 |
| CN | 101453813 | A | 6/2009 |
| CN | 201315688 | Y | 9/2009 |
| CN | 102262866 | A | 11/2011 |
| CN | 103246343 | A | 8/2013 |

* cited by examiner

PAGE DISPLAY METHOD AND TERMINAL

CROSS-REFERENCE TO RELATED APPLICATION

This application is a continuation application of U.S. patent application Ser. No. 15/209,534, filed on Jul. 13, 2016. U.S. patent application Ser. No. 15/209,534 is a Continuation of PCT/CN2015/072370, filed on Feb. 6, 2015, which claims priority of Chinese patent application 201410054236.3, filed on Feb. 18, 2014, the content of all of which is incorporated herein by reference in their entirety.

FIELD OF THE TECHNOLOGY

The present disclosure relates to the display field and, in particular, to a page display method and apparatus.

BACKGROUND OF THE DISCLOSURE

A screen of a terminal generally uses one of two light-emitting approaches: backlight light-emitting and self light-emitting. When the terminal uses the backlight light-emitting, the more pixels in a screen display region near white, the less power consumption. However, when the terminal uses the self light-emitting, the more pixels in the screen display region near black, the less power consumption. Besides, brightness of the screen also affects power consumption. The lower the brightness, the less the power consumption.

A user can do the followings to reduce power consumption of the terminal when browsing a page: lowering the brightness of the screen, or adding a white translucent shielding layer in the top layer of the page in a process of rendering the page when the terminal uses the backlight light-emitting, so that the page and the shielding layer can be transparently blended, and a foreground and a background of the page change toward white; or adding a black translucent shielding layer in the top layer of the page in a process of rendering the page when the terminal uses the self light-emitting, so that the page and the shielding layer can be transparently blended, and a foreground and a background of the page change toward gray.

However, there exist some problems when the lowering the brightness or adding the translucent shielding layer is used to reduce the power consumption. If the brightness of the screen is lowered, recognizability of the page is so low in a place with enough light that the user cannot view the page clearly. If the translucent shielding layer is added, contrast between the foreground and the background of the page becomes weak and picture quality is poor, so that the user cannot distinguish the foreground from the background, which affects the page browsing effect.

SUMMARY

According to one aspect, a page display method is provided, including: rendering a current page to be displayed to obtain a page image; acquiring gray values of pixels in the page image; determining a display mode of the page according to the gray values of the pixels in the page image, the display mode including a white mode and a black mode; judging whether the display mode matches a screen light-emitting type, the screen light-emitting type including backlight light-emitting and self light-emitting; and performing color inversion processing on the page image and displaying the processed page image when the display mode does not match the screen light-emitting type.

According to another aspect, a page display apparatus is provided, including: a rendering module, configured to render a current page to be displayed to obtain a page image; a gray value acquiring module, configured to acquire gray values of pixels in the page image; a display mode determining module, configured to determine a display mode of the page according to the gray values of the pixels in the page image, the display mode including a white mode and a black mode; a judging module, configured to judge whether the display mode matches a screen light-emitting type of a local end, the screen light-emitting type including backlight light-emitting and self light-emitting; and a display module, configured to perform color inversion processing on the page image and display the processed page image when the display mode does not match the screen light-emitting type.

BRIEF DESCRIPTION OF THE DRAWINGS

To describe the technical solutions of the embodiments of the present invention more clearly, the accompanying drawings for illustrating the embodiments will be introduced briefly in the following. Apparently, the drawings in the following description are only some embodiments of the present invention, and a person of ordinary skill in the art may obtain other drawings based on these accompanying drawings without creative efforts.

DESCRIPTION OF EMBODIMENTS

The following clearly and completely describes the technical solutions in the embodiments of the present invention with reference to the accompanying drawings in the embodiments of the present invention. Apparently, the described embodiments are some of the embodiments of the present invention rather than all of the embodiments. All other embodiments obtained by a person of ordinary skill in the art based on the embodiments of the present invention without creative efforts shall fall within the protection scope of the present invention.

Figure 5:
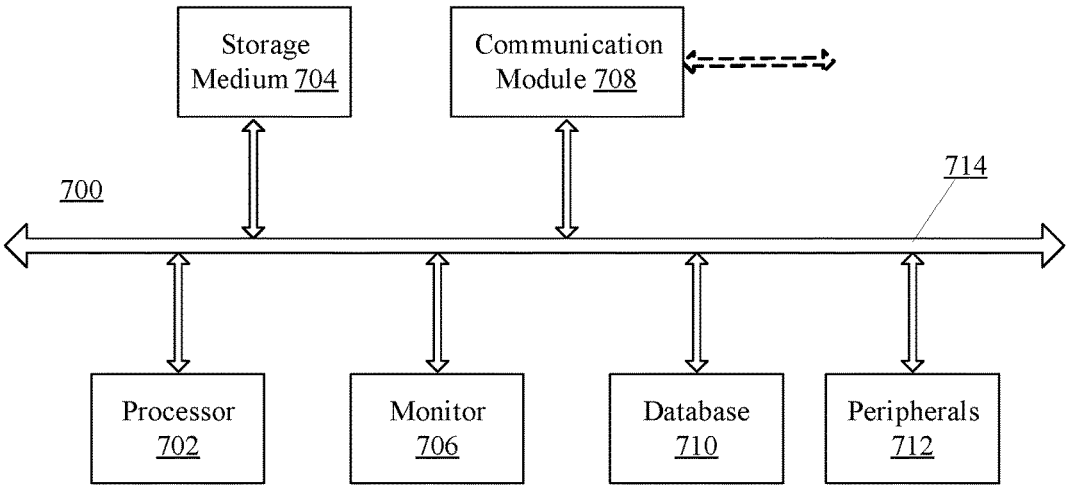
FIG. 5 is a schematic structural diagram of a terminal incorporating the page display apparatus as shown in FIG. 4.

FIG. 5 shows a block diagram of an exemplary terminals for executing various embodiments of methods, incorporates various apparatus corresponding to the various methods. The terminal 700, as used herein, may refer to any appropriate user terminal with certain computing capabilities, such as a personal computer (PC), a work station computer, a hand-held computing device (tablet), a mobile terminal (a mobile phone or a smart phone), a smart terminal, or any other user-side computing device. The terminal 700 may include a processor 702, a storage medium 704, a monitor 706, a communication module 708, a database 710, peripherals 712, and one or more bus 714 to couple the devices together. Certain devices may be omitted and other devices may be included. The processor 702 can include any appropriate processor or processors. Further, the processor 702 can include multiple cores for multi-thread or parallel processing. The storage medium 704 may include memory modules, e.g., Read-Only Memory (ROM), Random Access Memory (RAM), and flash memory modules, and mass storages, e.g., CD-ROM, U-disk, removable hard disk, etc. The storage medium 704 may store computer programs for implementing various processes, when executed by the processor 702. The monitor 706 may include display devices for displaying contents in the computing system 700. The peripherals 712 may include I/O devices such as keyboard and mouse. Further, the communication module 708 may include network devices for establishing connections through the communication network 602. The database 710 may include one or more databases for storing certain data and for performing certain operations on the stored data.

Figure 1:
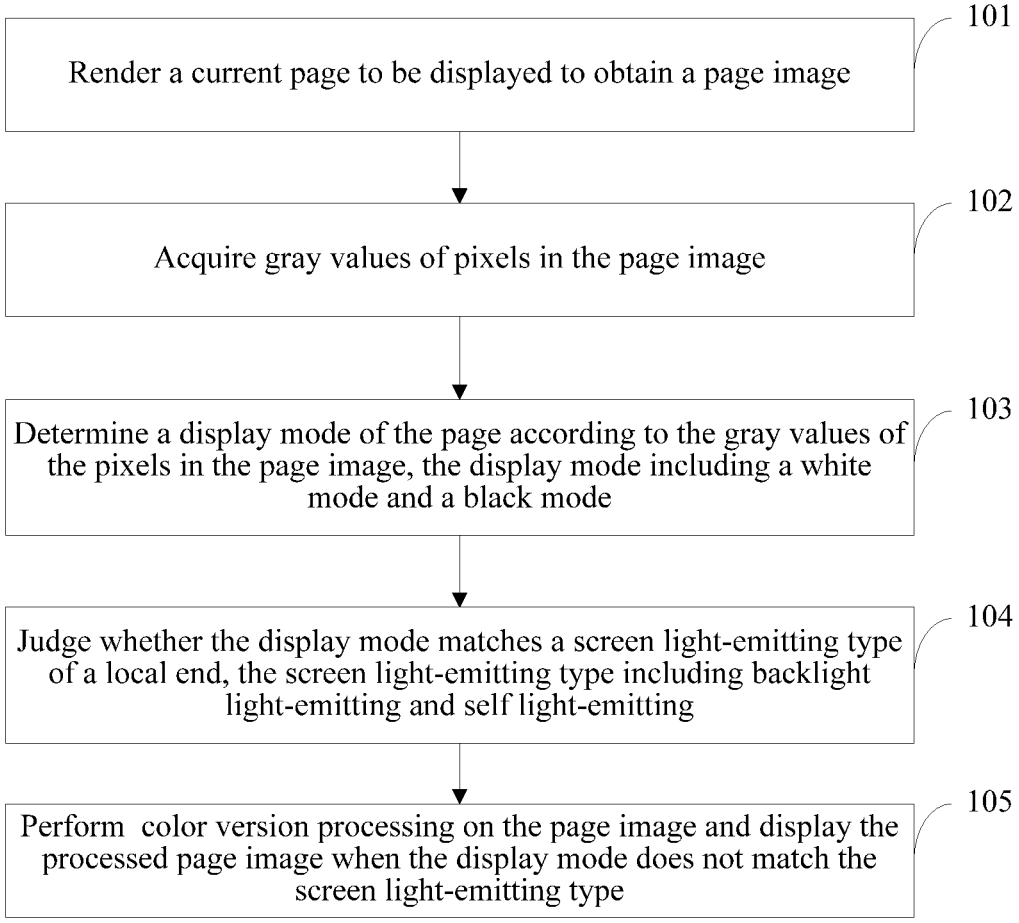
FIG. 1 is a flowchart of a page display method according to an embodiment of the present invention.

FIG. 1 is a flowchart of a page display method according to an embodiment of the present invention. Referring to FIG. 1, the method includes the following steps.

Step 101: Rendering a current page to be displayed to obtain a page image.

Step 102: Acquiring gray values of pixels in the page image.

Step 103: Determining a display mode of the page according to the gray values of the pixels in the page image, the display mode including a white mode and a black mode.

Step 104: Judging whether the display mode matches a screen light-emitting type of a local end, the screen light-emitting type including backlight light-emitting and self light-emitting.

Step 105: Performing color inversion processing on the page image and displaying the processed page image when the display mode does not match the screen light-emitting type.

The method provided in the embodiments of the present invention obtains the page image by rendering the current page to be displayed, judges whether the display mode of the page matches the screen light-emitting type of the local end according to the gray values of the pixels in the page image, and if the display mode does not match the screen light-emitting type, displays the page image after the color inversion processing is performed on the page image. In this way, not only power consumption is reduced, but also recognizability of the page and contrast between a foreground and a background are ensured, so as to prevent a problem that a user cannot view the page clearly or cannot distinguish the foreground from the background.

Optionally, the determining a display mode of the page according to the gray values of the pixels in the page image includes calculating an average value of the gray values of the pixels in the page image according to the gray values of the pixels in the page image; judging whether the average value obtained by calculation is less than a preset threshold; determining to use the white mode as the display mode of the page when the average value is not less than the preset threshold; and determining to use the black mode as the display mode of the page when the average value is less than the preset threshold.

Optionally, the preset threshold is 127.

Optionally, the judging whether the display mode matches a screen light-emitting type of a local end includes determining that the display mode matches the screen light-emitting type when the display mode is the white mode and the screen light-emitting type is the backlight light-emitting; or determining that the display mode matches the screen light-emitting type when the display mode is the black mode and the screen light-emitting type is the self light-emitting; or determining that the display mode does not match the screen light-emitting type when the display mode is the white mode and the screen light-emitting type is the self light-emitting; or determining that the display mode does not match the screen light-emitting type when the display mode is the black mode and the screen light-emitting type is the backlight light-emitting.

Optionally, elements of the page include a foreground image, and the performing color inversion processing on the page image and displaying the processed page image includes performing the color inversion processing on the elements except for the foreground image in the page image, and displaying the processed page image.

Optionally, elements of the page include a foreground image, and the performing color inversion processing on the page image and displaying the processed page image includes acquiring the foreground image and a position of the foreground image in the page image; performing the color inversion processing on the page image to obtain a first image; and drawing the foreground image on the first image according to the position of the foreground image in the page image to obtain a second image, and displaying the second image.

Any combination of the foregoing optional technical solutions can be used to form an optional embodiment of the present invention, which is not further described herein.

Figure 2:
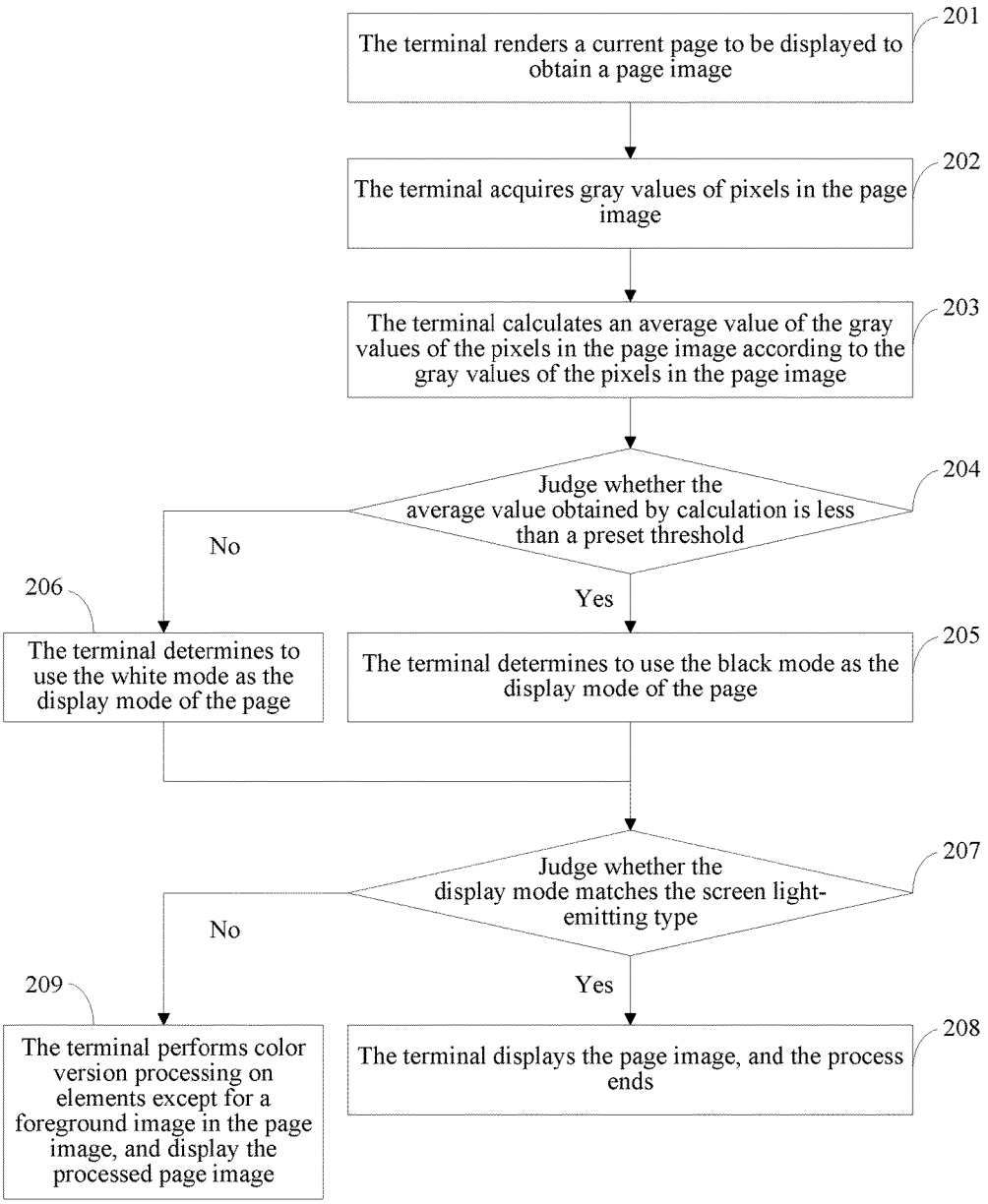
FIG. 2 is a flowchart of a page display method according to an embodiment of the present invention.

FIG. 2 is a flowchart of a page display method according to an embodiment of the present invention. This embodiment of the present invention is performed by a terminal. Referring to FIG. 2, the method includes the following steps.

Step 201: The terminal renders a current page to be displayed to obtain a page image.

This embodiment of the present invention is applied to a scenario in which a power saving mode the terminal is activated, and power consumption of the terminal needs to be reduced in a process of displaying the page.

The page to be displayed may be a webpage provided online by a server, and may also be a text document page locally stored in the terminal, and the like, which is not limited in the embodiments of the present invention. Accordingly, step 201 may include: the terminal sending a page display request to the server when the page to be displayed is a webpage provided online by the server, where the page display request carries a link address of the page, enabling the server to return a corresponding page according to the link address, and the terminal receiving and rendering the page to be displayed to obtain the page image; or acquiring the text document page if the terminal detects an operation of opening a text document when the page to be displayed is a text document page locally stored by the terminal, and rendering the text document page to obtain the page image.

Specifically, the terminal renders the page to a preset image to obtain the page image, or the terminal renders the page to data blocks, adjusts a format of the rendered data blocks to an image format to obtain the page image. When the page is rendered to the preset image, the preset image may be a bitmap.

Optionally, the terminal uses a preset algorithm to render the page and obtain the page image. The preset algorithm may be Open Graphics Library (Open GL) or Direct 3D (D3D), which is not limited in the embodiments of the present invention. In the embodiments of the present invention, the page is rendered to obtain the page image, and the page image includes all content of the page.

Optionally, the size of the page image is the same as the size of the screen of the terminal, so that the screen matches the page image. When the processed page image is subsequently displayed, the screen can display all the content in the processed page image, and does not cause waste of display space.

In this embodiment of the present invention, before step 201, the method further includes: judging whether the power saving mode of the terminal is activated; performing step 201 when the power saving mode of the terminal is activated; or directly displaying the page after the page is acquired when the power saving mode of the terminal is not activated.

Specifically, the terminal can provide a power saving option. When the user hopes to reduce the power consumption of the terminal, the power saving option is activated, and when the terminal detects an operation that the user activates the power saving option, it is determined that the power saving mode of the terminal is activated, and step 201 is performed, so that the power consumption of the terminal can be reduced in a process of displaying the page on the screen of the terminal. However, when the user does not need to reduce the power consumption of the terminal, the power saving option is deactivated, and when the terminal detects an operation that the user deactivates the power saving option, it is determined that the power saving mode of the terminal is deactivated, and the page is directly displayed after the page is acquired.

Step 202: The terminal acquires gray values of pixels in the page image. Specifically, when the terminal obtains the page image, gray processing is performed on the pixels in the page image to obtain the gray values of the pixels.

Step 203: The terminal calculates an average value of the gray values of the pixels in the page image according to the gray values of the pixels in the page image.

In this embodiment of the present invention, the terminal calculates the average value of the gray values of the pixels in the page image, and the average value can indicate, to a certain degree, that the pixels in the page image are near black or white.

Step 204: The terminal judges whether the average value obtained by calculation is less than a preset threshold, and if yes, step 205 is performed; otherwise, step 206 is performed.

Optionally, the preset threshold is 127. When the average value is not less than 127, it can be considered that a majority of pixels in the page are near white and a minority of pixels are near black. However, when the average value is less than 127, it can be considered that a majority of pixels in the page are near black and a minority of pixels are near white.

Step 205: The terminal determines to use the black mode as the display mode of the page, and step 207 is performed.

Step 206: The terminal determines to use the white mode as the display mode of the page, and step 207 is performed.

In the embodiments of the present invention, the display mode of the page includes the white mode and black mode. The white mode refers to that a majority of pixels in the page are near white, and the black mode refers to that a majority of pixels in the page are near black.

Step 207: The terminal judges whether the display mode matches the screen light-emitting type of the terminal, the screen light-emitting type including backlight light-emitting and self light-emitting, and if yes, step 208 is performed; otherwise, step 209 is performed.

In the embodiments of the present invention, the screen light-emitting type of the terminal includes backlight light-emitting and self light-emitting. Moreover, it can be known that when the screen light-emitting type is the backlight light-emitting, the more pixels in the page are near white, the less the power consumption of the terminal is, and when the screen light-emitting type is the self light-emitting, the more pixels in the page are near black, the less the power consumption of the terminal is.

Accordingly, step 207 may include any one of the following steps:

(207-1): Determining that the display mode matches the screen light-emitting type when the display mode is the white mode and the screen light-emitting type is the backlight light-emitting.

Based on step 206, the display mode is the white mode, and when the screen light-emitting type is the backlight light-emitting, it is determined that the display mode matches the screen light-emitting type.

(207-2): Determining that the display mode matches the screen light-emitting type when the display mode is the black mode and the screen light-emitting type is the self light-emitting.

Based on step 205, the display mode is the black mode, and when the screen light-emitting type is the self light-emitting, it is determined that the display mode matches the screen light-emitting type.

(207-3): Determining that the display mode does not match the screen light-emitting type when the display mode is the white mode and the screen light-emitting type is the self light-emitting.

(207-4): Determining that the display mode does not match the screen light-emitting type when the display mode is the black mode and the screen light-emitting type is the backlight light-emitting.

Step 208: The terminal displays the page image, and the process completes.

In this embodiment of the present invention, the page image includes all the content in the page. When the terminal displays the page image, all the content in the page can be displayed.

209: The terminal performs color inversion processing on elements except for a foreground image in the page image, and displays the processed page image.

Figure 6:
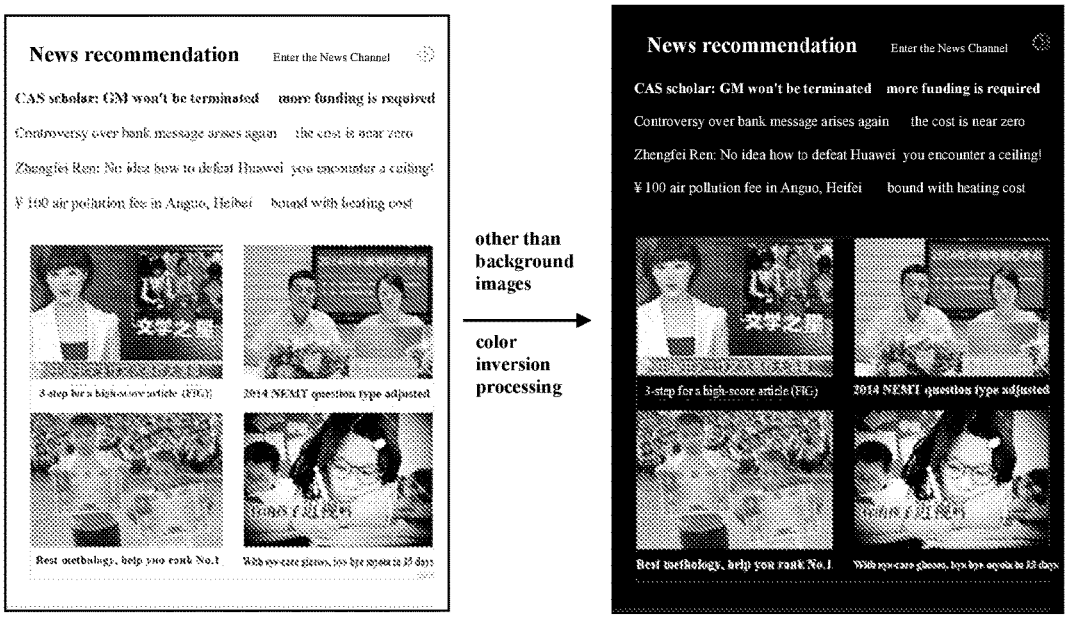
FIG. 6 illustrates an exemplary processing result according to an embodiment of the present invention.

The page includes multiple elements, such as the foreground image, background image, foreground text, and background text, which is not limited in the embodiments of the present invention. From the perspective of the user's visual depth, the background image is behind the foreground image, which is used for setting off the foreground image, and the background image is not connected to the foreground image. FIG. 6 illustrates an exemplary processing result.

In the embodiments of the present invention, when the terminal performs the color inversion processing on the page image, the terminal does not perform the color inversion processing on the foreground image. This is because the foreground image is not a simple black-and-white image and generally includes multiple colors. Once the color inversion processing is performed on the foreground image, the foreground image may change greatly and have a very poor picture quality, and the user is difficult to view content in the foreground image clearly.

Figure 3:
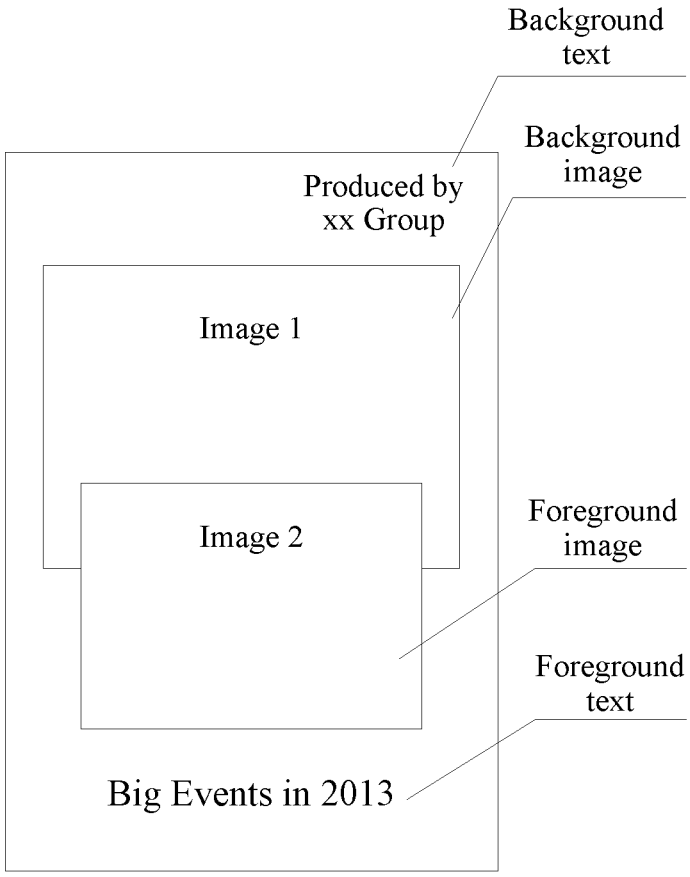
FIG. 3 is a schematic diagram of page elements according to an embodiment of the present invention.

Referring to FIG. 3, the elements of the page include background text "Produced by XX Group", a background image "Image 1", a foreground image "Image 2", and foreground text "Big Events in 2013".

With regards to the foreground text, it is assumed that the background color of the page is white and the color of the foreground text "Big Events in 2013" is black, after the terminal performs the color inversion processing on the foreground text and the background of the page, the background color of the page becomes black, and the color of the foreground text becomes white. In this way, recognizability of the page and contrast between the foreground characters and the background are not reduced.

However, the terminal does not perform the color inversion processing on the foreground image.

Optionally, the terminal acquires label attributes of images in the page, determines the foreground image in the page according to the label attributes of the images, acquires the elements except for the foreground image in the page image, performs the color inversion processing on the elements except for the foreground image, and displays the processed page image.

For example, in a cascading style sheet (CSS) code of the page, an image that is of a background attribute is the background image.

In another embodiment of the present invention, step 209 may be replaced by the following steps:

(209-1): The terminal acquires the foreground image and a position of the foreground image in the page image.

Different from step 209, in the another embodiment, after the color inversion processing is performed on the page image, the terminal redraws the foreground image on the page image, so as to ensure that the terminal can finally display the original foreground image.

Specifically, the terminal acquires the foreground image in the page and coordinates of the foreground image in the page when acquiring the image, and determines the position of the foreground image in the page image according to the coordinates.

(209-2): The terminal performs the color inversion processing on the page image to obtain a first image.

The terminal performs the color inversion processing on all the elements in the page image to obtain the first image.

(209-3): The terminal draws the foreground image on the first image according to the position of the foreground image in the page image to obtain a second image, and displays the second image.

Specifically, the terminal draws the foreground image at a position corresponding to the coordinates in the first image according to the coordinates of the foreground image to obtain the second image, and displays the second image. The foreground image in the second image is the original foreground image, and the color inversion processing is performed on other elements except for the foreground image.

The method provided in the embodiments of the present invention obtains the page image by rendering the current page to be displayed, judges whether the display mode of the page matches the screen light-emitting type of the local end according to the gray values of the pixels in the page image, and if the display mode does not match the screen light-emitting type, displays the page image after the color inversion processing is performed on the page image. In this way, not only power consumption is reduced, but also recognizability of the page and contrast between a foreground and a background are ensured, so as to prevent a problem that a user cannot view the page clearly or cannot distinguish the foreground from the background.

Figure 4:
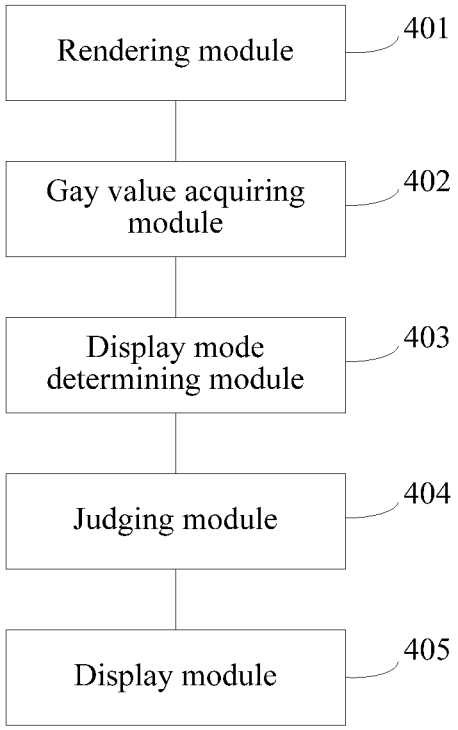
FIG. 4 is a schematic structural diagram of a page display apparatus according to an embodiment of the present invention.

FIG. 4 is a schematic structural diagram of a page display apparatus according to an embodiment of the present invention. Referring to FIG. 4, the apparatus includes a rendering module 401, a gray value acquiring module 402, a display mode determining module 403, a judging module 404, and a display module 405.

The rendering module 401 is configured to render a current page to be displayed to obtain a page image; the gray value acquiring module 402 is connected to the rendering module 401, and configured to acquire gray values of pixels in the page image;

the display mode determining module 403 is connected to the gray value acquiring module 402, and configured to determine a display mode of the page according to the gray values of the pixels in the page image, the display mode including a white mode and a black mode; the judging module 404 is connected to the display mode determining module 403, and configured to judge whether the display mode matches a screen light-emitting type of a local end, the screen light-emitting type including backlight light-emitting and self light-emitting; and the display module 405 is connected to the judging module 404, and configured to perform color inversion processing on the page image and display the processed page image when the display mode does not match the screen light-emitting type.

Optionally, the display mode determining module 403 includes an average value calculating unit, configured to calculate an average value of the gray values of the pixels in the page image according to the gray values of the pixels in the page image; an average value judging unit, configured to judge whether the average value obtained by calculation is less than a preset threshold; a first mode determining unit, configured to determine to use the white mode as the display mode of the page when the average value is not less than the preset threshold; and a second mode determining unit, configured to determine to use the black mode as the display mode of the page when the average value is less than the preset threshold.

Optionally, the preset threshold is 127.

Optionally, the judging module 404 includes: a first matching determining unit, configured to determine that the display mode matches the screen light-emitting type when the display mode is the white mode and the screen light-emitting type is the backlight light-emitting; or a second matching determining unit, configured to determine that the display mode matches the screen light-emitting type when the display mode is the black mode and the screen light-emitting type is the self light-emitting; or a third matching determining unit, configured to determine that the display mode does not match the screen light-emitting type when the display mode is the white mode and the screen light-emitting type is the self light-emitting; or a fourth matching determining unit, configured to determine that the display mode does not match the screen light-emitting type when the display mode is the black mode and the screen light-emitting type is the backlight light-emitting.

Optionally, elements of the page include a foreground image. The display module 405 is configured to perform the color inversion processing on the elements except for the foreground image in the page image and display the processed page image.

Optionally, elements of the page include a foreground image. The display module 405 includes: a foreground acquiring unit, configured to acquire the foreground image and a position of the foreground image in the page image; a color inversion processing unit, configured to perform the color inversion processing on the page image to obtain a first image; and a display unit, configured to draw the foreground image on the first image according to the position of the foreground image in the page image to obtain a second image, and display the second image.

The apparatus provided in the embodiment of the present invention obtains the page image by rendering the current page to be displayed, judges whether the display mode of the page matches the screen light-emitting type of the local end according to the gray values of the pixels in the page image, and if the display mode does not match the screen light-emitting type, displays the page image after the color inversion processing is performed on the page image. In this way, not only power consumption is reduced, but also recognizability of the page and contrast between a foreground and a background are ensured, so as to prevent a problem that a user cannot view the page clearly or cannot distinguish the foreground from the background.

It should be noted that, the division of the functional modules is used as an example to describe the process that the page display apparatus provided by the foregoing embodiment displays the page. In actual applications, the foregoing functions may be allocated to and implemented by different functional modules as required, that is, an internal structure of the device is divided into different functional modules, so as to implement all or a part of the functions described above. In addition, the page display apparatus provided by the foregoing embodiment and the page display method embodiments belong to one concept. For a specific implementation process, reference may be made to the method embodiments. Details are not further described herein.

A person of ordinary skill in the art may understand that all or some of the steps of the foregoing embodiments may be implemented by using hardware, or may be implemented by a program instructing relevant hardware. The program may be stored in a computer readable storage medium. The storage medium may be a read-only memory, a magnetic disk, an optical disc, or the like.

The foregoing descriptions are merely preferred embodiments of the present invention, but are not intended to limit the present disclosure. Any modification, equivalent replacement, or improvement made within the spirit and principle of the present disclosure shall fall within the protection scope of the present disclosure.

What is claimed is:

1. A page display method comprising:

obtaining a page image for displaying on a display device, the display device being a backlight display or a self light-emitting display;

acquiring gray values of a plurality of pixels of the page image;

calculating an average value of the gray values of the plurality of pixels in the page image;

when the average value is greater than a preset threshold and the page image is to be displayed on the self light-emitting display, performing a color inversion processing on the page image and displaying the processed page image on the self light-emitting display, wherein the self light-emitting display does not require an external light source; and when the average value is less than or equal to the preset threshold and the page image is to be displayed on the backlight display, performing a color inversion processing on the page image and displaying the processed page image on the backlight display.

2. The page display method according to claim 1, further comprising:

when the average value is greater than the preset threshold, determining a display mode of the page image as a white mode, wherein the white mode refers to that a majority of the pixels in the page image are near white.

3. The page display method according to claim 2, further comprising:

when the average value is less than the preset threshold, determining a display mode of the page image as a black mode, wherein the black mode refers to that a majority of the pixels in the page image are near black.

4. The page display method according to claim 3, before obtaining the page image, further comprising:

determining whether a power saving mode is activated.

5. The page display method according to claim 4, wherein the color inversion processing on the page image is performed when the power saving mode is activated, the display mode is the black mode and the page image is to be displayed on the backlight display.

6. The page display method according to claim 4, wherein the color inversion processing on the page image is performed when the power saving mode is activated, the display mode is the white mode and the page image is to be displayed on the self light-emitting display.

7. The page display method according to claim 1, wherein elements of the page image comprise a foreground image, and performing the color inversion processing on the page image and displaying the processed page image comprises:

performing the color inversion processing on the elements except for the foreground image in the page image, and displaying the processed page image.

8. The page display method according to claim 1, wherein elements of the page image comprise a foreground image, and performing the color inversion processing on the page image and displaying the processed page image comprises:

acquiring the foreground image and a position of the foreground image in the page image;

performing the color inversion processing on the page image to obtain a first image;

drawing the foreground image on the first image according to the position of the foreground image in the page image to obtain a second image; and displaying the second image.

9. The page display method according to claim 1, wherein the preset threshold is 127.

10. A terminal comprising:

a display device, the display device being a backlight display or a self light-emitting display;

a memory; and a processor coupled to the memory, wherein the processor is configured to:

acquire gray values of a plurality of pixels in the page image;

calculate an average value of the gray values of the plurality of pixels in the page image when the average value is greater than a preset threshold and the page image is to be displayed on the self light-emitting display, perform a color inversion processing on the page image and display the processed page image on the self light-emitting display, wherein the self light-emitting display does not require an external light source; and when the average value is less than the preset threshold and the page image is to be displayed on the backlight display, perform a color inversion processing on the page image and display the processed page image on the backlight display.

11. The terminal according to claim 10, wherein the processor is further configured to:

when the average value is greater than the preset threshold, determine a display mode of the page image as a white mode, wherein the white mode refers to that a majority of the pixels in the page image are near white.

12. The terminal according to claim 11, wherein the processor is further configured to:

when the average value is less than the preset threshold, determine a display mode of the page image as a black mode, wherein the black mode refers to that a majority of the pixels in the page image are near black.

13. The terminal according to claim 12, wherein the processor is further configured to:

determine whether a power saving mode is activated.

14. The terminal according to claim 13, wherein the color inversion processing on the page image is performed when the power saving mode is activated, the display mode is the black mode and the page image is to be displayed on the backlight display.

15. The terminal according to claim 13, wherein the color inversion processing on the page image is performed when the power saving mode is activated, the display mode is the white mode and the page image is to be displayed on the self light-emitting display.

16. The terminal according to claim 11, wherein elements of the page image comprise a foreground image, and perform the color inversion processing on the page image and display the processed page image comprises:

perform the color inversion processing on the elements except for the foreground image in the page image, and displaying the processed page image.

17. The terminal according to claim 11, wherein elements of the page image comprise a foreground image, and perform the color inversion processing on the page image and display the processed page image comprises:

acquire the foreground image and a position of the foreground image in the page image;

perform the color inversion processing on the page image to obtain a first image;

draw the foreground image on the first image according to the position of the foreground image in the page image to obtain a second image; and display the second image.

18. The terminal according to claim 11, wherein the preset threshold is 127.

* * * * *